United States Patent [19]

Wood

[11] 4,313,572

[45] Feb. 2, 1982

[54] ADJUSTABLE FLOW RATE FAN ATOMIZATION NOZZLE

[75] Inventor: George C. Wood, Edenton, N.C.

[73] Assignee: Patent Development of N.C., Raleigh, N.C.

[21] Appl. No.: 140,459

[22] Filed: Apr. 17, 1980

[51] Int. Cl.[3] ..... B05B 1/14

[52] U.S. Cl. ..... 239/598

[58] Field of Search ..... 239/597, 598, 390, 391, 239/552

[56] References Cited

U.S. PATENT DOCUMENTS

| | | | |
|---|---|---|---|
| 683,646 | 10/1901 | Gibbs | 239/597 X |
| 977,748 | 12/1910 | Milburn | 239/597 X |
| 1,121,654 | 12/1914 | Myers | 239/107 X |
| 1,271,939 | 7/1918 | Reeves | 239/597 X |
| 3,109,593 | 11/1963 | Newland | 239/275 |
| 3,252,661 | 5/1966 | Aldrich | 239/598 X |
| 3,584,786 | 6/1971 | Johnson | 239/597 X |
| 3,584,792 | 6/1971 | Johnson | 239/568 X |
| 3,731,517 | 5/1973 | Johnson | 239/367 |
| 3,737,101 | 6/1973 | Johnson | 239/225 |

*Primary Examiner*—Robert B. Reeves
*Assistant Examiner*—Gene A. Church
*Attorney, Agent, or Firm*—Munson H. Lane; Munson H. Lane, Jr.

[57] ABSTRACT

An adjustable flow rate nozzle for atomizing liquids comprises a tubular-like body for conducting a liquid under pressure having a discharge end terminating in a single plane surface, a structured device having a single plane surface which is attached with its plane surface contiguous with the plane surface of the tubular-like conduit and a slit-like aperature formed between the single plane surfaces of the tubular-like conduit and the structured device. The size of the slit-like aperture and thus the atomized flow rate is adjustable by securing structured devices to cooperate with the discharge end of the tubular-like body. The tubular body contains a main feed cavity of relatively large circular cross section and at least one corona cavity which is elongated outwardly from the main feed cavity. The corona cavity includes a pair of spaced sidewalls extending outwardly from the main feed cavity and an arcuate end wall joining the spaced side walls remote from the main feed cavity. The main feed cavity is internally threaded to receive a screw by which the structured device is positioned and fastened to the discharge end of the tubular-like body. In some embodiments of the invention, the structured device is formed separate from the screw used to hold it to the tubular body, while in other embodiments the head of the screw is modified to form the structured device.

13 Claims, 13 Drawing Figures

ADJUSTABLE FLOW RATE FAN ATOMIZATION NOZZLE

BACKGROUND OF THE INVENTION

1. Field of the Invention

This invention relates to an adjustable flow rate fluid atomization nozzle.

More particularly the invention relates to a nozzle which comprises an elongated tubular body of the corona cavity type, such as described in U.S. Pat. Nos. 3,584,786, 3,737,101 and 3,737,517, issued to William H. Johnson and assigned to Patent and Development of North Carolina, Inc., having a discharge end terminating in a single plane surface, a structured device having a single plane surface which is attached with its plane surface contiguous with the plane surface of the tubular-like body, and a slit-like aperture formed between the single plane surfaces of the tubular body and the structured device. The slitted aperture comprises a depression formed in the structured device to provide a flow path between the contiguous surfaces which is directed laterally outwardly from the axis of the tubular body. The head of the end machine screw can be used in one embodiment as a structured device. In another embodiment the depression is formed in both the contiguous plane surface of the tubular body and the structured device. The flow rate of the nozzle is adjustable by changing the size of the slitted aperture in one of several ways subsequently to be described.

2. Description of the Prior Art

Patents representative of the prior art of which applicant is aware are:

U.S. Pat. No. 1,121,654 Myers, Dec. 22, 1914
U.S. Pat. No. 3,584,786 Johnson, June 15, 1971
U.S. Pat. No. 3,737,101 Johnson, June 5, 1973
U.S. Pat. No. 3,731,517 Johnson, May 8, 1973
U.S. Pat. No. 3,584,792 Johnson, June 15, 1971
U.S. Pat. No. 3,252,661 Aldrich, May 24, 1966
U.S. Pat. No. 3,109,593 Newland, Sr., Nov. 5, 1963
U.S. Pat. No. 683,646 Gibbs, Oct. 1, 1901
U.S. Pat. No. 977,748 Milburn, Dec. 6, 1910

The Johnson U.S. Pat. Nos. 3,584,786, 3,584,792, 3,731,517, and 3,737,101 disclose fluid dispersion nozzles which have a main feed cavity and at least one fluidly connected corona orifice cavity. The term corona is used in describing the corona orifice cavity because the corona orifice cavity is crown-like and protrudes outwardly from the main feed cavity. The fluid atomization nozzles of the Johnson patents comprise a relatively large elongated main fluid feed conduit or body containing the main feed cavity and at least one smaller elongated discharge corona orifice portion or wing extending outwardly from the main feed conduit and forming the corona orifice cavity in section. The corona orifice cavity has spaced side wall surfaces extending outwardly from the main feed cavity and an arcuate end surface connecting the spaced side wall surfaces remote from the main feed cavity. The arcuate end wall surface of the corona orifice portion is slit transversely at one or more locations to form one or more orifices for fan shaped fluid dispersion. The arc diameter of the arcuate end wall surface ranges down to as little as 0.001 inch depending upon the degree of atomization desired and the included angle of the arcuate end wall may range up to 180°.

The Johnson nozzle disclosed in the aforesaid Johnson Patents achieve a finer degree of atomization and a wider angle of flat-fan atomization than had previously been achievable with other single unit nozzles. The uniqueness of the Johnson nozzle resides in its corona orifice cavity as a part of a long tube-like structure. The corona orifice cavity can be fabricated so that the distance between the opposing inner side walls and the diameter of the arc at its outer end wall, into which the orifice(s) is cut, may be very minute, down to 0.001 inch. The method of fabrication to achieve this character of the corona cavity is disclosed in Johnson U.S. Pat. No. 3,731,517. This produces a very fine fog-like atomization and a very wide angle fan-shaped dispersion. However, once the orifice is cut there is no way to adjust its opening dimensions except to enlarge them and thus only to increase the discharge rate. The discharge rate cannot be reduced in any other known practical manner, keeping all other factors constant. These latter factors are: (1) control of the quantity of fluid allowed to enter the main feed cavity and thence to the corona cavity and out through the slitted orifice; and (2) control of the fluid pressure at the orifice by changing the diameter of rotation and/or the speed of rotation (R.P.M.) in the case of rotary nozzle disclosed in U.S. Pat. No. 3,737,101, and by changing the pressure regulator in the fluid supply line in the case of stationary nozzles disclosed in U.S. Pat. Nos. 3,584,786 and 3,731,517. The aforementioned factors 1 and 2 do decrease the degree of atomization if any one or both are used.

3. Description of the Invention

This invention permits any individual, manufacturer or user to quickly and easily adjust the flow rate. Its main advantage lies with the manufacturer. He can provide the flow rate of discharge to meet the customer's discharge specifications by simply changing and/or positioning structured device(s). All elements can be mass produced to one set of specifications for each. This process materially decreases the cost of production.

As previously described this invention applies only to an aperture in the extreme outer end of the corona orifice structure. It does not apply to those apertures that may be cut along its length as described in Johnson U.S. Pat. No. 3,584,786.

In this invention the outer end of the corona orifice structure is machine cut and formed at right angle to the lengthwise axis of the structure. The center feed cavity is threaded at its outer end to receive a machine screw containing a structured device whose outer diameter is comparable to the outer dimensions as measured across the opposing corona orifice cavities, and will therefore just cover the end of one or more corona cavity(ies).

Securing a slitted aperture by partially closing the plane end of the corona cavity body with a structured device in which depressions of varying capacities are formed effects desired calibrations. The structure of this device could be applied to the end machine screw.

In some structured devices, depending on the shape, the end slitted aperture becomes a combination of half corona orifice with its before expressed wide angle flat fan, fine degree of atomization and a fanning out dispersion achieved by impinging fluid against a surface. This combination results in a small loss in the wide included angle of the fan and the degree of atomization, but is offset by the superior values achieved in manufacture and sales service. In one embodiment of the structured device covered herein, the shape of the aperture forms half of a true slitted aperture and meets precisely the specifications as revealed in Johnson U.S. Pat. No. 3,584,786. When combined and symmetrically positioned with the end of a corona orifice cavity in which half of the corona type aperture is formed, a true slitted corona aperture as described by Johnson results. A uniform flow of fluid to the aperture from both sides is achieved.

Two basic structured devices may be used and are described as follows:

1. The structured device has one or more depressions on the plane side to mount next to the plane end of the corona orifice structure. The depression can take any shape. For example, it may be a plane surface sloping from the outer edge inwardly. If the inner surface of the head of the end closure screw is used, a cone-shaped surface must extend completely around the circumference. The size of the aperture opening is adjustable in this case by changing to a screw having a different cone-shaped surface. The aperture can be formed with one-half in the structured device and the other half in the corona cavity. The adjustment of the rate will be described later herein. The difference between the two apertures lie in the fan type dispersion. When cut in the structured device only, the flat surface of the atomized fan is directed outwardly at an acute angle, slightly less than 90° to the central axis of the corona structure. When cut, half in the structured device and half in the corona cavity, the flat of the fan is essentially 90° to the lengthwise axis of the corona structure. Either of the above does not detract significantly from the degree of the atomization. The less than 90° angle improves somewhat the atomization in the rotatable unit.

Another example is a depression formed on the cooperating surface of the structured device shaped exactly and positioned symmetrically to a corona orifice cavity with one-half of a slitted aperture of the Johnson type. When both parts are so constructed and positioned, the result is an excellent corona type slitted aperture with near comparable results.

2. The structured device has one or more protrusions on its plane surface. The protrusion is shaped generally to the arc formed in the end of the corona cavity, as machined at an acute angle to the center axis on the outer end of the corona cavity. All surfaces, except the aperture opening, on the corona cavity body and the structured device fit tightly. The purpose of the protrusion is to cut down on the width of the aperture opening, not the angle of the arcuate end, when positioned to fit symmetrically within the orifice as cut in the corona cavity. The head of the end closure screw cannot be used in this case.

The rate of fluid discharge for No. 1 above is altered in one of two basic ways: one, positioning one of the depression shapes formed in one structured device plane face with the corona orifice cavity; two, positioning a structured device having the desired depression. In both cases the structured device may be retained in position by the end machine screw, also with the help of a suitably formed stop if so desired. The latter is commonly used in industry.

The rate of fluid discharge for No. 2 is altered by simply changing the structured device—one with a small protrusion for maximum rate; one with a large protrusion for reduced rate. These structured devices are also retained in place by the same end machine screw.

All structured devices may be identified by fluid rate calibration marks appropriately placed.

The maximum aperture opening should be formed so that the rate does not exceed the maximum safe power output in the case of the rotary motor operated unit.

In summary this invention comprises a corona type body and a structured device of comparable outside diameter. The outer end of the corona structure and the inner surface of the structured device when properly formed, fitted and fastened together forms a slitted aperture to produce flat fan shaped atomization patterns. The structured device is adjustable by changing to a different size of depression or protrusion having a different fluid discharge rate. The dimensions of the aperture are changed in this manner.

SUMMARY OF THE INVENTION

Accordingly, it is an object of the present invention to provide a device to adjust the fluid discharge rate of a flat fan dispersion pattern for centrifugally pressured fluid atomizers of the type that employs one or more corona cavities and orifices as covered in Johnson U.S. Pat. No. 3,737,101, and for stationary pressured fluid atomizers of the type that employs one or more corona cavities and orifices as covered in Johnson U.S. Pat. No. 3,584,786.

A second objective is to provide an adjustable rate device at the end of Johnson's corona orifice cavity structure.

A third objective is to provide a device in which the rate of fluid discharge is modified by changing the dimensions of the aperture without substantially changing the fine degree of atomization for any given pressure.

A fourth objective is to provide an adjustable aperture of such dimensions as characterized by Johnson to achieve an unusually fine fog-like range of adjustment, in contrast to dispersion only by fluid hitting a baffle plate or surface.

A further objective is to provide an adjustable rate aperture for fluids, of such dimensions as characterized by Johnson U.S. Pat. No. 3,584,786 in combination and cooperation with the principle of dispersion achieved by fluid hitting a surface, with a small sacrifice of atomization qualities in preference to simplicity, ease of manufacture, cleaning and fluid rate of adjustment.

BRIEF DESCRIPTION OF THE DRAWINGS

With the foregoing objects and features in view and such other objects and features which may become apparent as the specification proceeds, the invention will be understood from the following description taken in conjunction with the accompanying drawings, wherein like characters of reference designate like parts and wherein.

DESCRIPTION OF THE PREFERRED EMBODIMENTS

Figure 1:
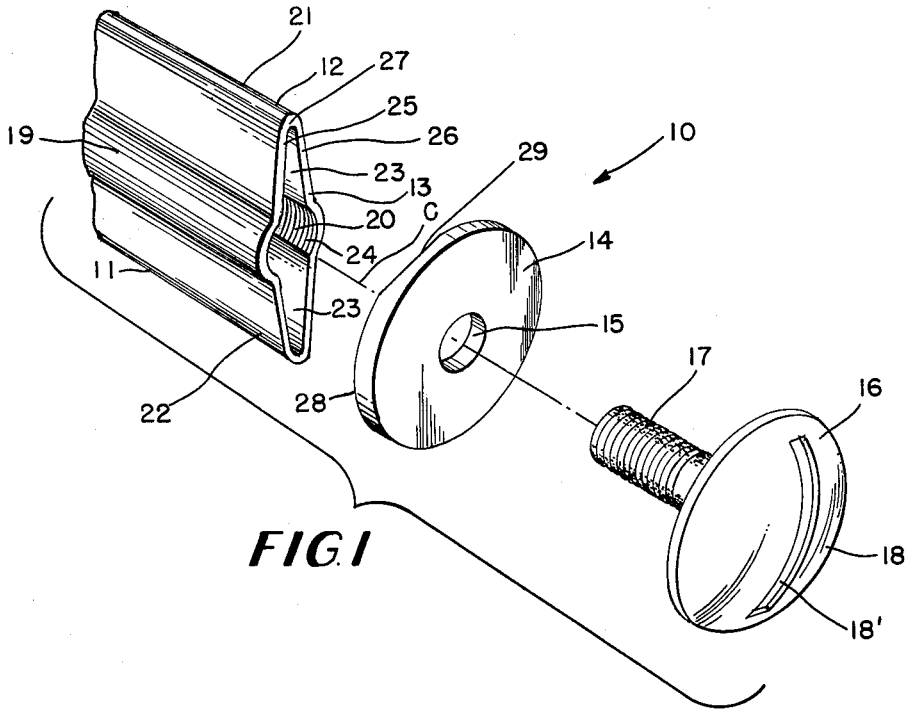
FIG. 1 is an exploded perspective view showing only the discharge end portion of one corona orifice body, one embodiment of a structured device of comparable outside dimension and the end machine screw.

Referring now to the drawings, and particularly to FIGS. 1–5, an aperture formed in accordance with the present invention is generally indicated by the reference numeral 10. The nozzle 10 comprises an elongated tubular-like nozzle body with conduit 11 having a discharge end 12 terminating in a single plane 13, a structured device 14 having a central opening 15 and a screw having a threaded shank 17 and a head 18 with slot 18' which fastens the structured device 14 against the discharge end of the nozzle body 11 in the manner shown in FIG. 2.

The nozzle body 11 includes a main feed portion 19 containing a main feed cavity 20 of relatively large circular cross section and two diametrically opposite corona wings 21,22, each containing a corona cavity 23. The discharge end portion of the main feed cavity has internal threads 24 for receiving the threaded shank 17 of the screw 16. Each corona cavity 23 includes a pair of spaced side walls 25,26 extending outwardly sometimes parallel from the main feed cavity 20 and an arcuate end wall 27 joining the spaced side walls 25,26 remote from the main feed cavity. The corona cavity opens into the central feed cavity along its length and receives fluid therefrom.

The nozzle body 11 is generally similar in shape to the nozzle disclosed in the Johnson U.S. Pat. Nos. 3,584,786, 3,584,792, 3,737,101 and 3,731,517 previously described, however, the end 13 of the body 11 is cut off or otherwise machined in a single plane perpendicular to the central axis C. While two corona cavities 23,23 are shown in the embodiment of FIG. 1, it is within the scope of the invention for the nozzle body 11 to be formed with only one corona cavity opening into the main feed cavity 20, or to be formed with more than two corona cavities. In any case, a separate structured device 14 as shown in FIG. 1 or the head of a screw modified as will be subsequently described, is positioned against the end 13 of the nozzle body and cooperates with the nozzle body to form at least one aperture or discharge orifice between the structured device and the discharge end of the nozzle body for the discharge of fluid from the nozzle.

Figure 2:
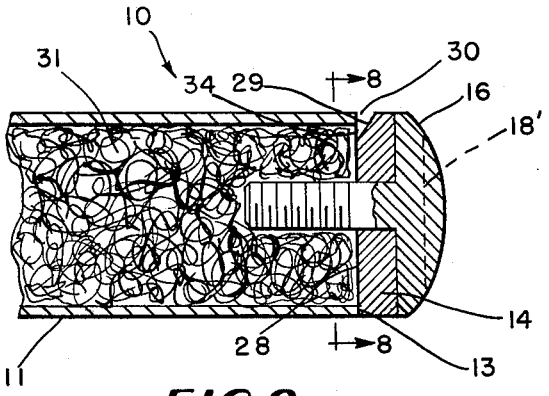
FIG. 2 is a vertical longitudinal section through the nozzle of FIG. 1 showing the nozzle elements in assembled relationship.
Figure 3:
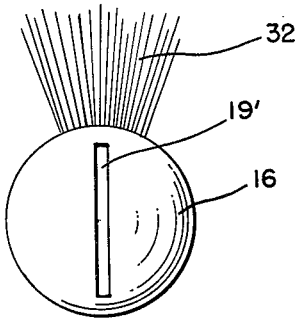
FIG. 3 is an end view of the discharge end of the nozzle of FIG. 2 on a slightly reduced scale showing the wide flat fan-shaped dispersion of fluid being discharged from the aperture.
Figure 4:
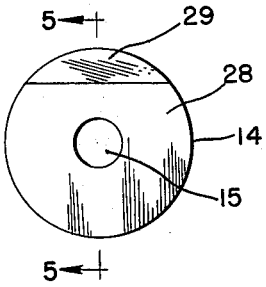
FIG. 4 is a left-hand end view of the structured device forming a part of the nozzle assembly of FIG. 1 and showing the face of the structured device having one depression only which cooperates with the discharge end of the corona orifice body.
Figure 5:
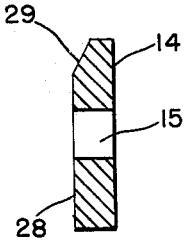
FIG. 5 is a sectional view taken on line 5—5 of FIG. 4.

As seen particularly in FIGS. 2, 4, and 5, the structured device 14 having an outside diameter comparable to the nozzle body has a major inner planar surface 28 which is intersected across one end by a flat beveled surface 29 to form one type of depression. Although this configuration is the easiest to manufacture, it can take many shapes to be described later. When the structured device 14 is secured with its inner face 28 contiguous with the single plane surface 13 of the nozzle body, the depression 29 forms a slit-like aperture 30 adjacent the outer arcuate end 27 of the corona cavity 23. The liquid 31 which fills the nozzle body and is under pressure is forced through the slit-like aperture 30 at slightly less than a 90 degree angle to the central nozzle axis C. The right end view of the nozzle as seen in FIG. 3 illustrates how the liquid fans out in a flat stream 32 to achieve maximum atomization.

Figure 6:
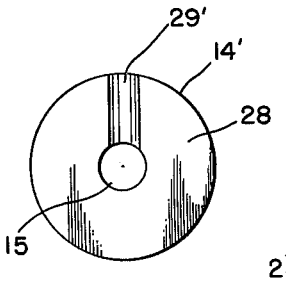
FIG. 6 is a view similar to FIG. 4 of another structured device. The side edges of the depression, which is the lengthwise half of a hollow cylinder, are parallel and are to cooperate with similar parallel side wall of the corona wing.
Figure 7:
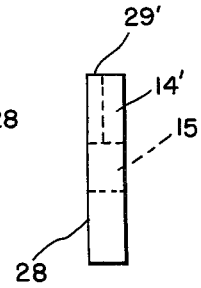
FIG. 7 is a side elevational view of the structured device shown in FIG. 6.

In FIGS. 6 and 7 another embodiment 14' of a structured device for use with the nozzle body 11 in lieu of the structured device 14 is shown. The device 14' has a central opening 15, a flat inner planar surface 28, and a machined depression 29' formed in a uniform half-round configuration that extends outwardly vertically toward the circumference of 14'. The depression 29' when set opposite the corona cavity 23 forms an aperture or discharge orifice for the nozzle 10. More than one depression, each with different dimensions may be formed on one device 14' or, another device having a depression of different dimensions may be used. In each case, the rate is changed according to the dimensions of the depression set opposite the cavity. In FIGS. 6 and 7, the edges of the depression are shown parallel. In this case the sides of the cavity 23 must be parallel and identically spaced also.

Figure 8:
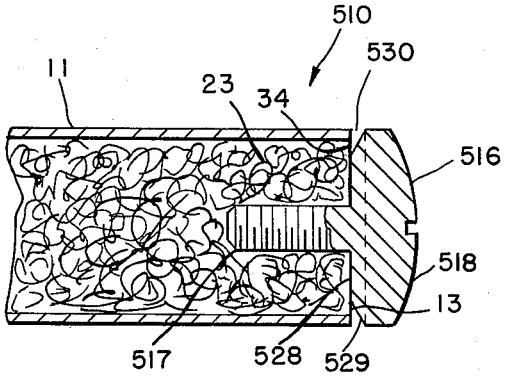
FIG. 8 is a sectional view taken on line 8—8 of FIG. 2 illustrating the use of the end machine screw as a structured device.

FIG. 8 shows a nozzle 510 having a nozzle body 11 of the type shown in FIG. 1, but instead of using a separate structured device and screw as in the nozzle 10 of FIG. 1, a screw 516 is provided with a threaded shank 517 and a head 518 of comparable outside diameter to the structured device 14 which has a planar inner surface 528 machined circumferentially by an outwardly sloping cone shaped surface 529. Since the screw head 516 is formed so that it takes place of a separate structured device, the flow rate of the nozzle 510 is adjustable by substituting different screws 516 provided with cone-shaped depressed surfaces 529 of different shapes to provide orifice openings 530 of different sizes.

Figure 9:
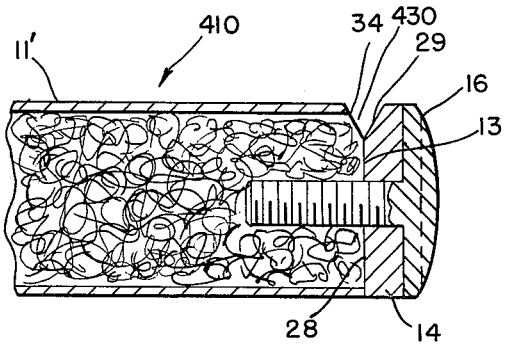
FIG. 9 is a sectional view similar to FIG. 2 with the aperture formed half in the corona body and half in the structured device.

FIG. 9 shows, in longitudinal section, another embodiment 410 of the invention using a nozzle body 11' with depression 34 formed in the planar end face 13 and a structured device 14 of the type shown in FIGS. 4 and 5 having planar face 28 and a flat bevel face 29 cooperating to form a fluid discharge aperture 430.

Figure 10:
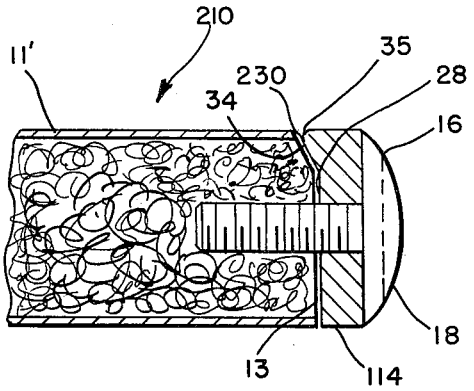
FIG. 10 is a vertical longitudinal section through another embodiment of the invention that uses a protrusion on the structured device.

FIG. 10 shows still another nozzle embodiment 210 of the invention using a nozzle body 11' of the type shown in FIG. 9. with a depression formed in its end face 13 and using a structured device 114 which differs from other structured devices such as 14 and 14' in that it has a protrusion 35 projecting from the planar face 28 instead of the depressions 29 and 29' respectively formed in the devices 14 and 14'. The protrusion 35 faces the depression 34 and cooperates with the depression to form a fluid discharge aperture 230. Although the nozzle body 11', the structured device 114 and the screw head are shown spaced slightly apart in FIG. 10, it will be understood that the structured device is held tightly against the end face 13 of the nozzle body 11' by tightening the screw 16. Using the nozzle 210 adjustment of the flow rate is achieved by substituting structured devices 114 having protrusions 35 of different dimensions. The discharge rate of the atomized fluid is varied by changing the size of the protrusion and thus the size of the aperture.

Figure 11:
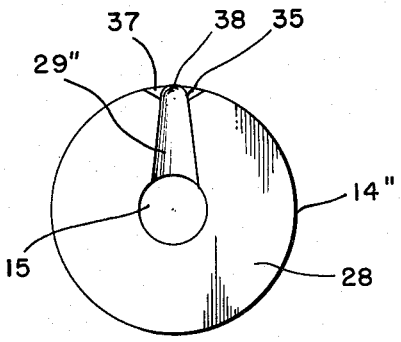
FIG. 11 is a view similar to FIG. 6 in which the structured device is formed with a depression near identical to the slitted aperture on the end portion of the corona orifice body shown in FIGS. 1, 9 and 10.
Figure 12:
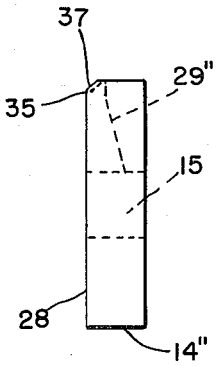
FIG. 12 is a side elevational view of the structured device shown in FIG. 11.

FIGS. 11 and 12 show another preferred embodiment of a structured device 14'' for use with the nozzle body 11 in lieu of 14 and 14'. The device 14'' has a central opening 15, a flat inner planar surface 28 with a machine formed depressions 29''.

Depression 29'' is a half round cone widest and deepest at the central opening 15, and narrowest and shallowest at the outer arc end 38. If the side walls of the corona cavity 23 are parallel, depression 29'' remains comparable in width, the depth remains variable as shown in FIG. 12. In addition a small surface 37 is machined formed sloping away from 29'' to provide an edge 35 and arc 38 corresponding with the arc formed by a corona aperture 34. When positioned symmetrically with depression formed in the planar end face 13 shown in FIG. 9, a near ideal corona cavity aperture results.

Figure 13:
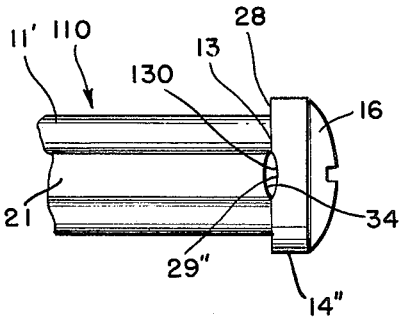
FIG. 13 is a top plan view of FIG. 9 or 10 but using the structured device of FIGS. 11 and 12 to form a near identical corona type aperture.

FIG. 13 shows a top view of the corona cavity aperture 130 as formed between the corona body 110 and structured device 14'' shown in FIGS. 11 and 12. The discharge rate of the fluid is varied by changing the depth of the depression but not its side edges unless the corona cavity apertures are changed accordingly.

It is further to be understood that all depressions and protrusions on the structured device can be changed to one that will form a larger or smaller aperture opening 130,230, 430 and 530 symmetrically positioned with a half corona cavity opening 25 and 34 to effectuate a change in fluid flow rate.

Although not shown, graduation marks and indicia can be inscribed or otherwise appropriately placed upon the structured device 14 to indicate different flow rates. The same applies near or on the planar end of the corona body 11.

It is to be understood that the discharge end of the nozzle 10 may be shaped all or part of its entire length like the nozzles shown in the aforementioned Johnson patents, and further it may be especially shaped at the supply end for a connection to a source of fluid supply.

In all material contained herein, a "V" shaped aperture is used. It is understood that any of the surface slits mentioned in Johnson U.S. Pat. No. 3,584,786, such as V and rectangular will be applicable in this invention.

In summary, it is apparent that a number of different and adjustable flow rates can be made by using various combinations of the structured devices and nozzle bodies described herein.

Although not shown, a thin resilient washer may be inserted between the structured devices of any of the embodiments of the invention and flat underside of the head 18 of screw 18.

While in the foregoing there has been described and shown a preferred embodiment of the invention, various modifications and equivalents may be resorted to within the spirit and scope of the invention as claimed.

What is claimed is:

1. An adjustable flow rate fluid atomization nozzle comprising an elongated corona type tubular body in which fluid is pressurized having a planar fluid discharge end and a structured device removably secured to said elongated corona type tubular body at said discharge end and cooperating with said planar discharge end to form at least one atomizing orifice for atomizing said pressured fluid, said elongated tubular body comprising an elongated main feed conduit having a central axis and a relatively large cross-sectional area, and at least one corona discharge wing member of less cross-sectional area than the main fluid conduit extending substantially parallel with the main fluid conduit and communicating with the interior thereof, said corona discharge wing member including a corona orifice cavity having a pair of spaced side walls extending outwardly from the main feed cavity and an arcuate end wall joining the spaced sidewalls remote from said main feed cavity, said structured device having a planar surface contiguous with the planar discharge end of said elongated tubular body, said at least one atomizing orifice being formed between the planar surface of said structured device and the planar discharge end of said tubular body adjacent said arcuate end wall of said corona orifice cavity, said structured device having an outer radius which is substantially the same as the outer radius of said corona type tubular body measured from said central axis to the outside of said arcuate end wall to achieve dispersion only at the said atomizing orifice, and means securing said structured device to said discharge end whereby said structured device can be either rotated or replaced with a different structured device to achieve different rates of fluid discharge.

2. The atomizing nozzle of claim 1 wherein said corona type tubular body includes at least a pair of corona discharge wing members extending diametrically on opposite sides of said main feed cavity, and said structured device cooperates with said planar fluid discharge end of said corona type tubular body to form one of said atomizing orifices adjacent the arcuate end wall of at least one of said corona discharge wing members.

3. The atomizing nozzle of claim 2 wherein there is one of said atomizing orifices formed adjacent the arcuate end wall of each of said corona discharge wing members.

4. The atomizing nozzle of claim 1 wherein said elongated main feed conduit includes internal threads adjacent said fluid discharge end, and said means securing said structured device to said discharge end includes screw fastening means cooperating with said internal threads.

5. The atomizing nozzle of claim 4 wherein said structured device is of a circular disc-like shape having a central bore, and said screw fastening means includes a shank extending through said central bore on which said structured device is mounted, said shank being slightly smaller in diameter than said bore whereby said structured device may be rotated thereon, and said shank having an externally threaded end portion which engages the internal threads of said main feed conduit to firmly secure said structured device contiguously against the planar fluid discharge end of said corona tubular body with said structured device in a selected adjusted position to produce a desired flow rate.

6. The atomizing nozzle of claim 5 wherein the plane surface of said structured device is interrupted by at least one depression to form at least one of said atomizing orifices adjacent the arcuate end wall of one corona orifice cavity.

7. The fluid atomization nozzle of claim 1 wherein the plane surface of said structured device is interrupted by at least one depression to form said at least one atomizing orifice adjacent the arcuate end wall of said corona orifice cavity.

8. A fluid atomizing nozzle as set forth in claim 7 wherein the discharge flow rate is increased or decreased by positioning a depression of said structured device, having a different discharge rate, in cooperation with the corona orifice cavity.

9. The fluid atomization nozzle of claim 1 wherein the planar fluid discharge end of said corona type tubular body is interrupted by a depression extending through said arcuate end wall and said planar surface of said structured device is interrupted by at least one depression, the depression of said structured device cooperating with the depression in said planar fluid discharge end to form said at least one atomizing orifice.

10. A fluid atomization nozzle as set forth in claim 9 wherein the fluid flow discharge rate is increased or decreased by the positioning of said structured device having a different rate in cooperation with the depression of said corona orifice cavity.

11. The fluid atomizing nozzle of claim 1 wherein said planar fluid discharge end of said corona type tubular body is interrupted by a depression extending through said arcuate end wall of said corona orifice cavity, and the planar surface of said structured device is interrupted by a protrusion positioned in said depression on the planar fluid discharge end of said corona type tubular body to form said atomizing orifice.

12. A fluid atomizing nozzle as set forth in claim 11 wherein the discharge flow rate of the atomized fluid is varied by the amount of said protrusion extending into said corona orifice cavity depression.

13. The fluid atomizing nozzle of claim 1 wherein the planar fluid discharge end of said corona type tubular body has a depression extending through said arcuate end of said corona orifice cavity, and wherein said planar end of said structured device has a depression of symmetrical structure, the depressions in said discharge end and in said structured device being positioned opposite each other symmetrically and cooperating to form said at least one atomizing orifice, said atomizing orifice being in the form of a uniform narrow transverse slit of semi-circular cross section with fluid flowing thereto from both sides.

* * * * *